United States Patent [19]

Slate

[11] 4,122,825

[45] Oct. 31, 1978

[54] AIR-HEATER TYPE FIREPLACE GRATE

[76] Inventor: Robert C. Slate, 8225 17th NE, Seattle, Wash. 98115

[21] Appl. No.: 776,119

[22] Filed: Mar. 10, 1977

[51] Int. Cl.[2] ..... F24B 7/00

[52] U.S. Cl. ..... 126/121; 126/164; 165/180

[58] Field of Search ..... 126/121, 164, 165; 165/180

[56] References Cited

U.S. PATENT DOCUMENTS

| | | | |
|---|---|---|---|
| 912,980 | 2/1919 | Evans | 126/243 |
| 1,758,638 | 5/1930 | Young | 165/180 |
| 3,002,729 | 10/1961 | Welsh | 165/180 |
| 3,905,351 | 9/1975 | Hatfield et al. | 126/121 |
| 4,018,209 | 4/1977 | Bonvicini | 126/121 |

*Primary Examiner*—Ronald C. Capossela
*Attorney, Agent, or Firm*—Graybeal, Barnard & Uhlir

[57] ABSTRACT

A compact, blower driven, fireplace air heater is provided that is adapted to be inserted into a conventional fireplace to increase the heat output thereof, and including a generally coplanar arrangement of a cool and a warm air manifold connected by a plurality of parallel, cool air conduits oriented perpendicularly with respect thereto. A plurality of warm air conduits are preferably arranged parallel to and coplanar with the cool air conduits, with each having one end terminating in the warm air manifold and the other, discharge end passing through the cool air manifold. Cool room air propelled by the blower is first warmed as it passes from the cool air manifold to the warm air manifold through the cool air conduits, and is further warmed as it passes from the warm air manifold through the warm air conduits prior to being discharged into the room through the discharge ends thereof. Preferably, an ash screen helps to retain the burning fuel while permitting ashes to fall therethrough into an ash pan inserted into the open front of the base. The base and the front wall of the ash pan provide means to regulate the flow of combustion air to the fire from below.

14 Claims, 8 Drawing Figures

Fig. 1
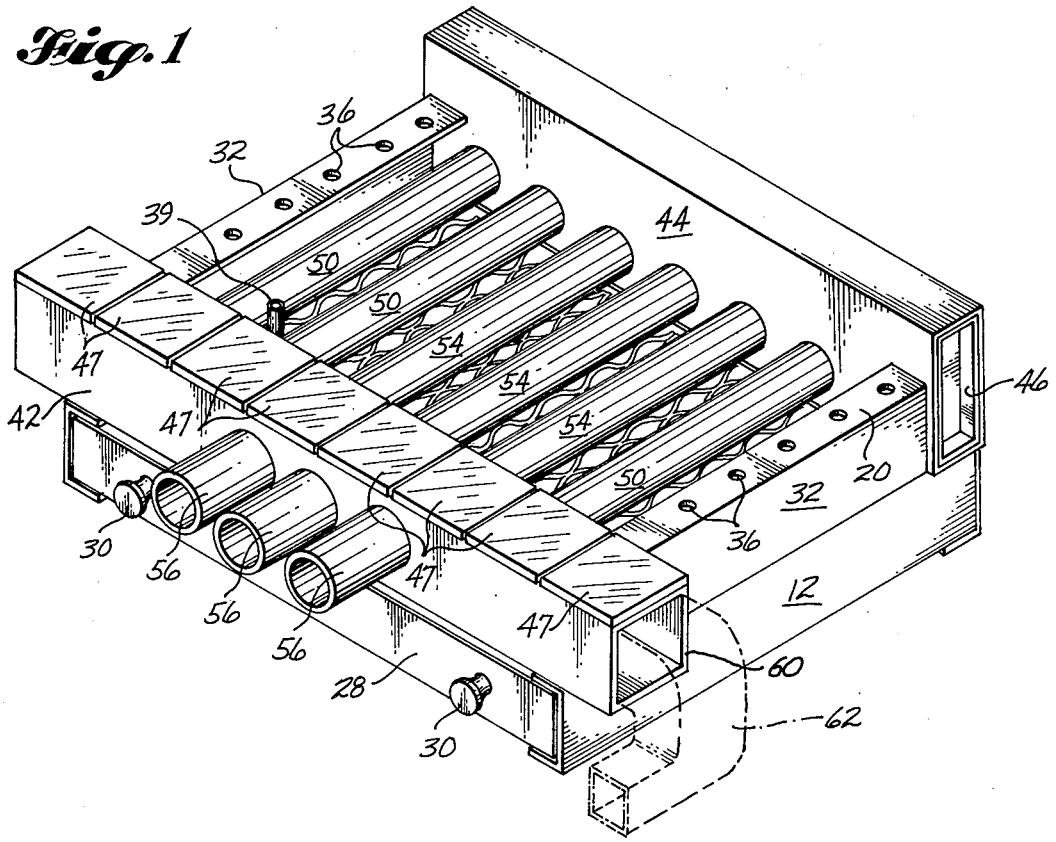
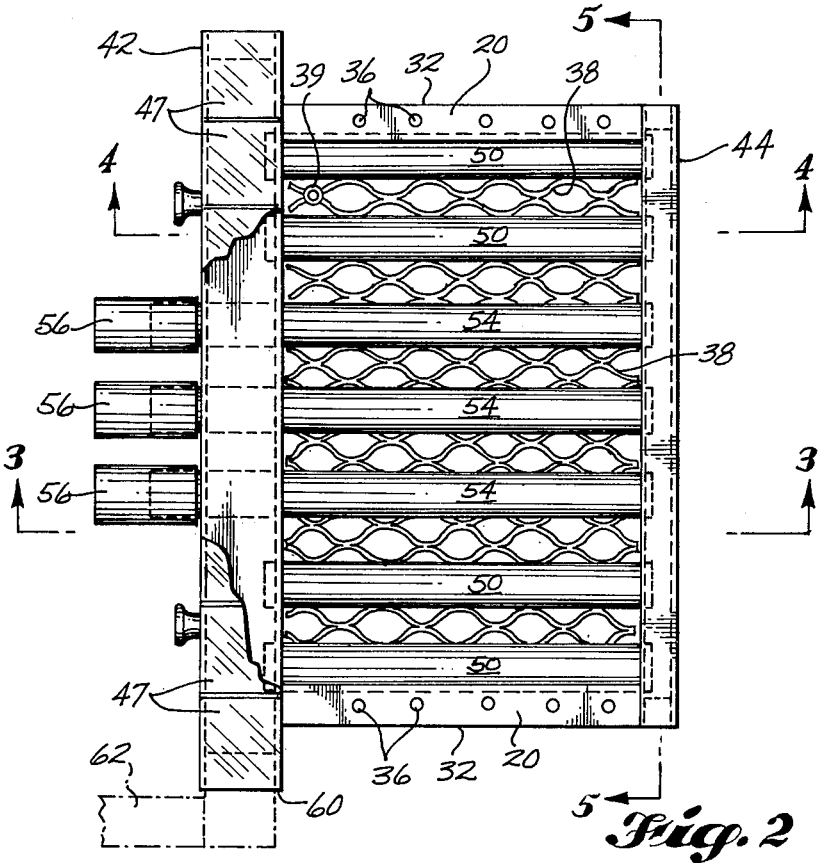
Fig. 2

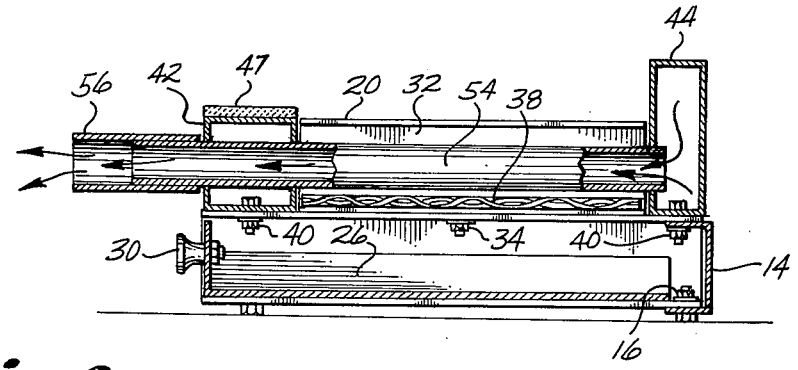
Fig. 3
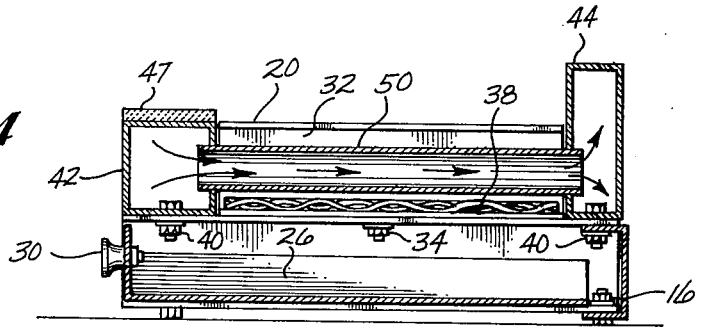
Fig. 4
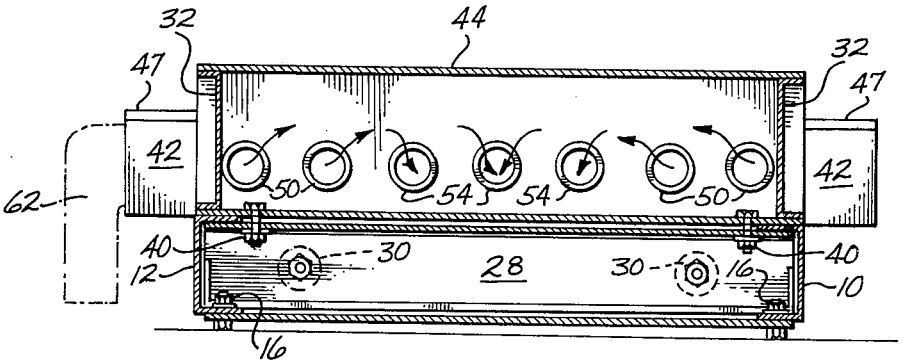
Fig. 5
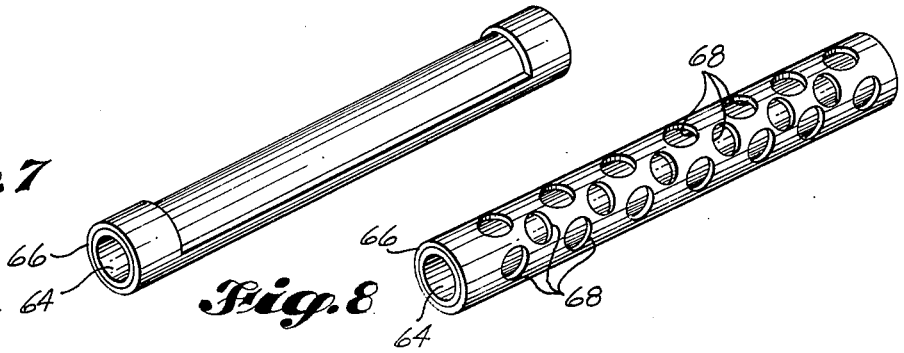
Fig. 7
Fig. 8

AIR-HEATER TYPE FIREPLACE GRATE

BACKGROUND OF THE INVENTION

1. Field of the Invention

The present invention relates to fireplace air heaters and more particularly to blower driven fireplace air heaters having front and rear manifolds connected by a plurality of air conduits so arranged that the air they convey passes at least twice near the fire built on the top thereof.

2. Description of the Prior Art

It is well known that a conventional fireplace is a very inefficient device for heating a room or a house, in that great quantities of air, besides that needed for combustion, are withdrawn from the room and exhausted up the chimney along with the flue gases. Cool air entering the room from the outside to replace that passing up the chimney results in the familiar phenomenon of a user with a warm front and a cold back.

As the fuel prices continue to rise, the necessity for converting the fireplace from an inefficient, decorative device to a more efficient, useful appliance has become imperative.

Of course, since the poor performance of the conventional fireplace has long been known, numerous ways to improve its heat output have been devised. One common solution is the convection heater that basically comprises a plurality of parallel C-shaped pipes, upon the base of which the fire is built. As the pipes are warmed by the fire, cool room air is drawn by convection into their bottom openings and is discharged from their top openings. To increase efficiency, a blower may be added which injects air into the bottom openings to thereby improve air circulation through the pipes, and a series of deflectors may be added which concentrate the hot flue gases on the top portion of the pipes, as disclosed in U.S. Pat. No. 3,955,553, granted May 11, 1976 to Soeffker.

Such devices suffer from the drawback that if the fire does not cover the base of all of the tubes, there may be a cold draft emitted by any tube not in contact with the fire. Making the fire larger to heat these tubes may result in a wasteful surplus of heat, and reducing the number of tubes so that only a small fire can be used may cause a cold room due to insufficient heating. Further, such devices make no provision for regulating the primary and secondary combustion air to the fire so that the fire will flare wastefully when the volatile substances in the wood are burned resulting in inefficient utilization of the fuel and increased amounts of pollutants emitted into the air.

Another solution proposed involves a blower driven, generally horizontal array of air tubes. This may involve one long air tube bent so that it partially encircles the fire as disclosed by U.S. Pat. No. 3,001,521 granted Sept. 26, 1961 to Reilly; or there may be a centrally located air tube supplying a plurality of parallel air delivery tubes, all of which pass beneath the fire as disclosed by U.S. Pat. No. 3,942,509 granted Mar. 9, 1976 to Sasser.

As before, later devices have many drawbacks and they too provide no method for controlling the draft to the fire to regulate the rate at which the fuel burns. Further, they are difficult and expensive to manufacture since they involve bending air tubes which are likely to be made of heat resistant steel. In addition, they are of one-piece or welded construction which makes impossible quick and inexpensive replacement of a damaged or burned out air tube. Another drawback of these devices is that they provide no effective means for preventing the coals and unburned fuel from dropping through the grate, resulting in a portion of each charge of fuel being wasted. Finally, as all the referenced patents disclose, cleaning the fireplace of ashes and waste material is a tedious, difficult, time consuming and dirty job involving either inconvenient sweeping beneath and around the device or dismantling and removing it from the fireplace each time ash removal is required.

BRIEF SUMMARY OF THE INVENTION

In basic form, the fireplace air heater of the present invention includes a front, cool air manifold having an inlet adapted to receive cool room air from a blower. A plurality of cool air conduits convey air from the cool air manifold to the rear, warm air manifold. Air from the warm air manifold is returned to the room through a plurality of warm air conduits whose discharge ends open to the room adjacent the front of the warm air manifold. In use, the fireplace air heater of the present invention is placed in a conventional fireplace and a fire is built on top of the cool and warm air conduits. Thus, the unit is both an air heater and a grate. Cool room air is warmed as it is forced by the blower in sequence through the cool air manifold, the cool air conduits, the warm air manifold and the warm air conduits prior to its discharge into the room.

According to an aspect of the present invention, the grate includes a base which defines a forward opening recess adapted to removably receive an ash pan. In addition, an ash screen is specified that is located adjacent the top of the base to retain coals and unburnt fuel while permitting ashes to fall through into the ash pan.

It is an object of the present invention to provide a low cost, easy to manufacture fireplace air heater. This is accomplished by further aspects of the present invention which specify the front and rear manifolds, and the cool and warm air conduits to be straight, tubular metal members. This, of course, means that all of these members can be manufactured by simply cutting up lengths of readily available, off-the-shelf metal tubular material. Further, since the manifolds and air conduits, are specified to be straight, there is no bending required for these elements, which greatly simplifies manufacture and hence also lowers the cost. This construction also satisfies the object that the present invention be readily manufactured in a variety of sizes to conveniently match the fireplace or desires of the particular user. Another object of the present invention is to provide a fireplace air heater which burns the fuel it uses more efficiently, thereby promoting even burning, complete combustion of the volatile substances present in the wood, and less pollution. This is done by some aspects of the present invention which increase regulation of the access of primary and secondary combustion air to the fuel by providing a closed base and ash pan; and by providing side panels and front and rear manifolds which are elevated above the top surface of the cool and warm air conduits.

A further object of the present invention is to provide a fireplace air heater which is easily assembled without welding and which has components which, when worn or burnt out, are easily replaced. By eliminating welded construction, the present invention is readily adapted to be supplied to the user in kit form which will reduce the cost to him considerably.

Another object of the present invention is to eliminate cold drafts emanating from the discharge ends of the air conduits by specifying a rear manifold which mingles and mixes the air received from the cool air conduits, thereby providing air of a relatively uniform temperature. This object is further reached by specifying that the air from the warm air manifold is then conveyed through warm air conduits which are centrally located, and thus the air is uniformly reheated since these conduits are located directly under the central portion of the fire.

A further object is to increase operator convenience by specifying the fireplace air heater of the present invention to include an ash screen and a base which defines a forward opening recess adapted to receive an ash pan. Thus, the fire is retained and the ashes are conveniently accumulated for easy removal without disturbing or having to move the fireplace air heater. Further, no sweeping out of ashes is required in contrast to many prior art fireplace air heaters.

Another object of the present invention is to provide bimetallic cool and warm air conduits of a unique construction which offers significantly greater efficiency than the steel conduits normally employed in such devices.

A further object of the present invention is to provide a compact fireplace air heater by specifying that the warm air conduits pass through apertures in the front, cool air manifold. In addition, since the cool and warm air conduits act as a grate for the fire, a separate grate is neither desired nor required.

These and further objects, features, advantages and characteristics of the fireplace air heater of the present invention will be apparent from the following more detailed description of the preferred embodiments.

BRIEF DESCRIPTION OF THE DRAWING

FIG. 1 is a front perspective view from an upper aspect of the fireplace air heater of the present invention showing a forced air blower in phantom;

FIG. 2 is a top plan view thereof with certain portions cut away to show the details of construction;

FIG. 3 is a cross sectional view of the fireplace air heater illustrated in FIG. 2 taken substantially along line 3—3 thereof;

FIG. 4 is a cross sectional view of the fireplace air heater illustrated in FIG. 2 taken substantially along line 4—4 thereof;

FIG. 5 is a cross sectional view of the fireplace air heater illustrated in FIG. 2 taken substantially along line 5—5 thereof.

FIGS. 7 and 8 are front perspective views from an upper aspect of other embodiments of cool and warm air conduits suitable for use in the present invention.

DESCRIPTION OF THE PREFERRED EMBODIMENTS

Figure 6:
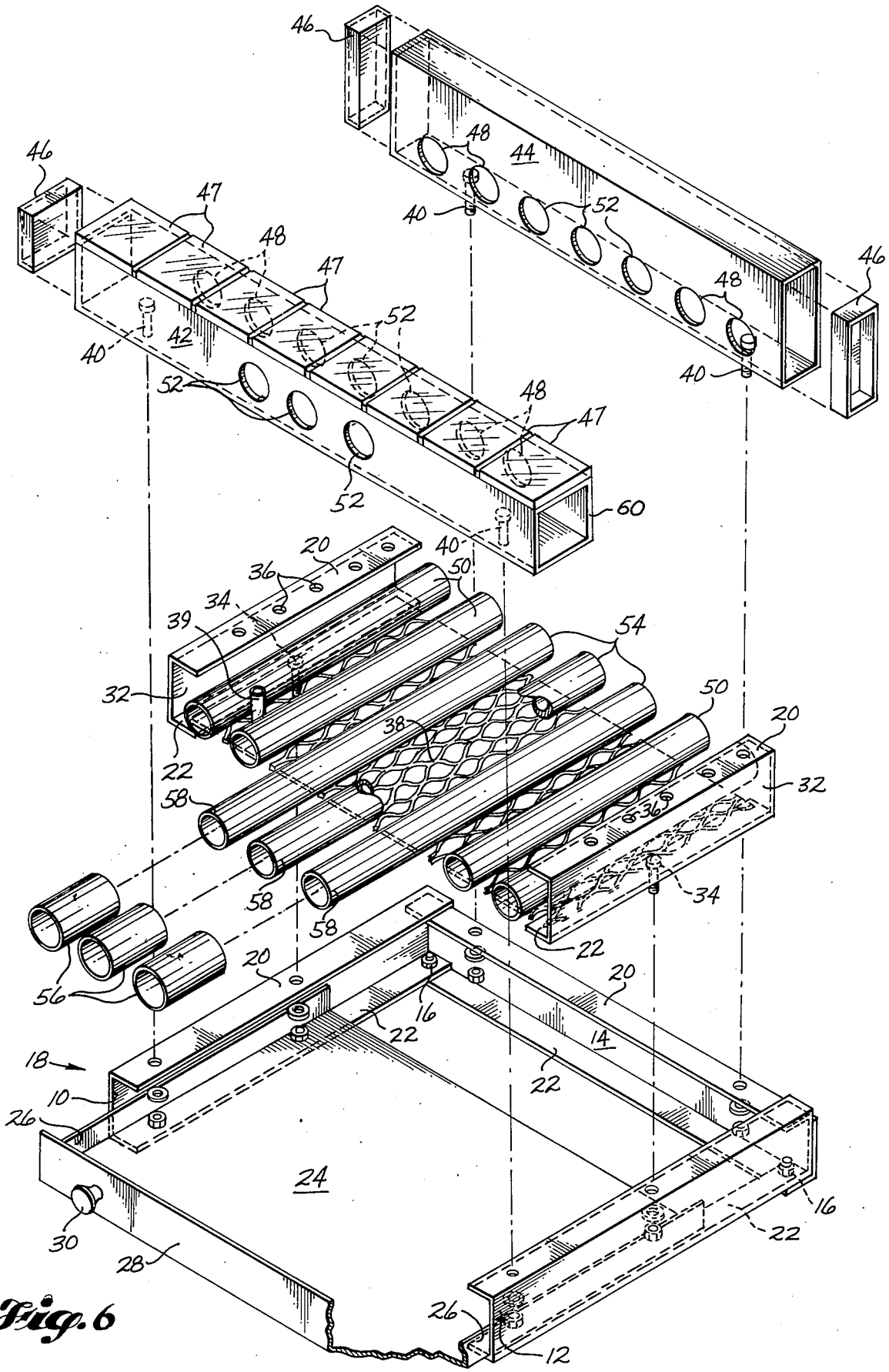
FIG. 6 is an exploded view of the fireplace air heater of the present invention.

Referring now to the accompanying figures, and in particular to FIGS. 1, 2, and 6, the fireplace air heater of the present invention is supported by a generally rectangular base defining a forward opening recess 18 and comprising a left, right and rear walls 10, 12, 14 detachably joined at the intersections of the left and right walls 10, 12 with the rear wall 14 by removable base fasteners 16, such as nuts, bolts, and washers. Each wall 10, 12, 14 comprises a straight segment of three inch channel metal such as iron or steel, formed from suitably bent sheet metal or other similar material, for example, and has upper and lower flanges 20, 22. Of course, those skilled in the art will appreciate that various other forms of base could be provided, such as a plurality of support legs, not illustrated; or other materials could be used to form the base such as angle iron.

The left and right channels 10, 12 open inwardly and their flange and web portions define slideways for an ashpan 24. Each channel 10, 12 includes a lower flange 22 upon which a generally rectangular ash pan 24 rides. The ash pan has left and right side walls 26 and a front wall 28 sized to completely fill or cover the forward opening recess 18 defined by the base when the ash pan is fully inserted therein. When the ash pan is full of ashes or needs cleaning, it can be removed by pulling on the handles 30. In other words, the ashpan 24 is moved into and out from the slideways like a drawer. In a preferred form, the ash pan 24 is formed from sheet metal, and has no rear wall so that ashes may be neatly and conveniently poured from the rear of the pan, eliminating the need to tip the pan over to clean it, which is always a messy, clumsy process. Although an ash pan 24 is preferred, it is possible that one not be used, in which case it is also possible that the forward opening recess 18 of the base be closed by a front channel member, not shown. In this case, ashes will accumulate in the compartment defined by the walls of the base until removed through recess, or until removed by tipping or lifting the base and then sweeping out the ashes.

Left and right upper side members 32 are detachably secured to the top of the left and right base walls 10, 12, as by removable fasteners 34, such as a nut, bolt and washer combination. Each side member 32 has upper and lower flanges 20, 22 and comprises a straight length of three inch channel metal such as iron or steel, formed from suitably bent sheet metal or other suitable material, for example, but it could also be formed of any other suitable material such as angle iron. Channel metal is preferred for the base walls 10, 12, 14 and side members 32 because it is durable, relatively cheap, easily formed from sheet metal, and has upper and lower flanges 20, 22 which make assembly with fasteners a simple and easy process since the flanges 20, 22 may be overlapped to serve as mounting lugs. The side members 32 are multipurpose members and may include accessory apertures 36 spaced along their upper flanges 20 which serve to support the legs of a grill, a shish kebab rack, or the like. In addition, they serve as a support for the fuel, particularly when a relatively long log is being burned.

Detachably mounted to the lower flanges 22 of the side members 32 in an ash screen 38 which may be conveniently formed from expanded metal mesh or the like. In preferred form, the ash screen rests freely on the lower flanges 20 of the side panels 32. The ash screen is not a necessity, but is preferred to help retain the coals and fuel while allowing the ashes to fall therethrough. Secured to the ash screen, as by a fastener, not shown, is an apertured screen shaking lug 39 into the top of which a shaking tool, not shown, may be inserted to vibrate the ash screen 38 to encourage accumulated ashes, which might otherwise insulate the cool and warm air conduits 50, 54 from the fire, to fall through into the ash pan 24.

Detachably mounted across the fronts and rears of the left and right base walls 10, 12, as by removable manifold fasteners 40, such as a nut, bolt and washer combination, are a cool air manifold 42 and a warm air manifold 44, respectively. The cool air manifold 42 and the warm air manifold 44 are straight members which may be cut, for example, from stock three inch by three inch and two inch by five inch tubular metal box material, respectively. Iron or steel is preferred, and it should be noted that the manifolds 42, 44 can also be formed from round tubular metal material or sheet metal. Of course, the dimensions of the manifolds 42, 44 could be changed so that they are, larger or smaller; or so that they are of equal size. As shown by FIGS. 1-5, the ends of upper side members 32 fit square or close against the inner faces of manifolds 42, 44, resulting in rigid corners even though a single bolt 40 is used at each corner. The base members 10, 12, 14; members 32 and manifolds 42, 44 together define the frame of the grate.

Inserted in one end of the cool air manifold 42 and in both ends of the warm air manifold 44 are sheet metal end plugs 46 sized to be snugly received with a relatively airtight fit in the ends of their respective manifolds, as by a press fit. The end plugs 44 seal the ends they plug to prevent leakage of air from the manifolds 42, 44. In preferred form, the end plugs are cut from sheet metal. Aluminum is preferred since the coefficient of expansion for aluminum is greater than that of iron or steel, and thus the end plugs will seal more tightly as the manifolds become hot.

Across the top of the cool air manifold 42 is cemented a plurality of tiles 47 which are preferred, but not necessary. The tiles serve a decorative function, but also serve a protective function in that they are more resistant to heat and sparks than a paint protected manifold would be.

A plurality of cool air conduit apertures 48, eight being illustrated, are formed in the rear of the cool air manifold 42 and in the front of the warm air manifold 44. Each aperture 48 is sized to snugly receive, in a friction fit, one end of a cool air conduit 50, with corresponding apertures 48 in the cool and warm air manifolds 42, 44 being axially aligned when the present invention is assembled. The length of each cool air conduit 50 is selected so that a portion of each of its ends will extend a moderate distance into its respective manifold, as is best seen in FIG. 4.

A plurality of warm air conduit apertures 52, nine being illustrated, are formed in the cool and warm air manifolds 42, 44; with six in the cool air manifold and three in the warm air manifold. Each aperture 52 is sized to snugly receive, in a friction fit, one end portion of a warm air conduit 54; with corresponding apertures 52 in the cool and warm air manifolds 42, 44 being axially aligned when the present invention is assembled. As best seen in FIG. 3, the length of each warm air conduit 54 is selected so that a portion of one end will extend into the warm air manifold 44 for a moderate distance while the other end extends through the cool air manifold 42 and protrudes therefrom for a short distance. A brass, chrome-plated, or the like, extension tube 56 may be optionally secured to the forward end portions of the warm air conduits 54 for decorative purposes and to enhance the eye appeal of the present invention.

A friction fit is preferred between the cool and warm air conduits 50, 54 and their respective apertures 48, 52 in the cool and warm air manifolds in order to enable these conduits to slip within their respective apertures during heating to eliminate bonding or warping of the tubes which would otherwise result in stress and premature failure. The apertures 48, 52 are sized so that the fit is snug enough to permit such movement without allowing an undue leakage of air between the ends of the conduits 50, 54 and the apertures 48, 52 they are received in. Together the air conduits 50, 54, the cool and warm air manifolds 42, 44 and the side panels 32 form a fire grate, which is a distinct advantage of the present invention since it renders a separate fire grate unnecessary. It is seen, as in FIG. 1, that the cool and warm air manifolds 42, 44, the cool and warm air conduits 50, 54 and the side panels are generally coplanar, with the cool and warm air conduits 50, 54 being parallel to each other and perpendicular to the cool and warm air manifolds 42, 44.

Each air conduit 50, 54 comprises a straight segment of metal tubing. Although each may be formed entirely of steel or iron, each tube may also be bimetallic. Two basic forms of bimetallic tubes may be used, with the first being a steel tube jacketed by a surrounding tube composed of a metal of high heat conductivity such as copper or aluminum. Such construction exhibits good conductance of heat along the tube, and the oxidation resistance of the copper or aluminum outer tube helps prevent the tubes from burning out. Bonding the outer metal to the inner metal provides best heat transferance therebetween but is costly.

A less costly construction involves selecting the tube sizes such that the outer diameter of the inner tube is slightly smaller than the inner diameter of the outer tube. Then the finished bimetallic tube can be assembled by merely inserting the inner tube into the outer tube. This construction has the benefit of long life and low cost, but perhaps is not the most efficient construction. Inefficiency results when, as the tubes warm, the small air gaps between the inner and outer tubes enlarge as the copper or aluminum, having a high coefficient of expansion, expand away from the inner tube, leaving an air gap thereby resulting in poor heat transferance between the two.

The second basic form involves assembling the bimetallic tube as before, except the inner tube is composed of copper or aluminum and the outer tube is steel. Now as the tubes heat, the inner tube expands into tight contact with the outer tube, resulting in good conduction of heat from the outer tube to the inner tube. In addition, the high conductivity inner tube more readily conveys heat to the air passing therethrough, and also conveys heat along its entire length from its hot central portion that is near the fire to its cooler end portions that are further away from the fire, resulting in still greater thermal transfer of heat from the inner tube to the air contained therein.

To further increase efficiency, it is realized that a tube composed entirely of a metal of high thermal conductivity such as copper or aluminum would be preferred, but unfortunately these metals are relatively weak and have a relatively low melting which would cause them to sag or melt under the weight of a hot fire. To overcome this disadvantage, it is possible for the cool and warm air conduits 50, 54 to be formed as in FIG. 7, with the inner tube 64 being a metal such as copper or aluminum and the outer tube 66 being a strong, heat resistant metal such as steel. Here at least a portion of the length of the outer tube 66 has been removed, exposing the inner tube 64 directly to the heat of the fire, while the strength of the outer tube 66 prevents sagging. Melting of the inner tube is prevented by both the cooling effect of the air passing within it, and the self heat sink effect of the inner tube, in that heat from the hot exposed portion is conducted to the relatively cool, sheathed end portions. Of course, other forms of this concept are possible, and will readily occur to those skilled in the art such as the form shown in FIG. 8. This form is substantially identical to that shown in FIG. 7, except that instead of a portion of the top of the outer tube 66 being cut away, the outer tube is perforated by a plurality of large, heat admitting apertures 68.

Each air conduit 50, 54 shown in FIG. 6 may have an outer diameter of 1¾ inches, but of course, they may be larger or smaller. A greater number of either cool or warm air conduits could be provided, and there may be as few as two cool air conduits and one warm air conduit. Spacing between the air conduits is not critical, with the spacing shown being about seven-eighths of an inch.

In preferred form, the warm air conduits 54 are centrally located and the cool air conduits 50 are located laterally adjacent thereto, as shown in FIG. 2. This configuration has substantial eye appeal due to its symmetrical appearance and, in addition, has another advantage. Heated air received by the warm air manifold 44 from the cool air conduits 50 is mixed therein, bringing it to a relatively uniform temperature. This desirable uniformity of temperature is maintained as the air is heated for a second time while passing through the centrally located warm air conduits 54. Since the warm air conduits are located beneath the center of the fire, it is ensured that each will be heated, thereby eliminating the possibility of a relatively cold blast of air being emitted from one of them. Of course, other arrangements of the cool and warm air conduits are possibly departing from the spirit of the present invention. For example, the cool air conduits could be located in a parallel arrangement adjacent the air inlet and perpendicular to the cool air manifold; and the warm air conduits could be arranged parallel to the cool air conduits remote from the air inlet.

An inlet adapter 62, shown in phantom in FIG. 1, is connected to the inlet 60 of the cool air manifold 42. The inlet 60 and the blower, not shown, can be located at either end of the cool air manifold, according to the needs of the user and arrangement of his furniture, and is much more convenient than a centrally fed cool air manifold 42. The blower can also be adapted to draw air from outside the room containing the fireplace or even from outside the house. In the latter case, the blower will supply a positive differential air pressure to the fireplace room thereby reversing the normal flow of cool air into the fireplace room from exterior room and from outside the house. In this configuration of the present invention, such cool air sources are elemental and warm air from the fire place room is forced into the exterior rooms. At the same time, since all intake air is thoroughly mixed in the warm air manifold, it is assured that no unheated air will have a direct path into the room which would create very cold air drafts.

It will be noted that the entire fireplace air heater of the present invention, except for cementing the tiles to the top of the cool air manifold, is accomplished by either a relatively snug friction fit or by assembly with nut, bolt and washer combinations, or other suitable removable fasteners. Welding is not required in any part of this construction, but could possibly be used. In addition, many of the major components such as the manifolds 42, 44, air conduits 50, 54, and extension tubes 56 are straight, members that are formed merely by cutting the proper length from stock, off the shelf tubular metal.

Such nonwelded construction of straight members made from stock materials has several outstanding features. Firstly, relatively low cost is possible because all these components are cut from readily available, off the shelf materials and none of them, except for the ash pan end plugs, base walls and side panels, which are formed from sheet metal, require bending. In addition, the use of friction fit and removable fasteners permits quick and easy assembly without costly welding, which permits the sale of the present invention in kit form. Such construction also makes possible the use of interchangeable parts produced by mass production and, very importantly, allows easy and cheap replacement of damaged or burned-out members.

In operation, the fireplace air heater of the present invention is inserted into a conventional fireplace, now shown, and a fire of wood, coal or the like is built on top of the cool and warm air conduits 50, 54. The blower, connected to the inlet adapter 62, withdraws cool air from the room and delivers it in to the cool air manifold. The cool air delivered thereto then passes, as best seen in FIG. 4, into the cool air conduits 50 which convey it to the warm air manifold 44. There, the air from all the cool air manifolds 50 is mixed and passes, as shown in FIGS. 3 and 5, into the warm air conduits 54 which return the warmed air into the room. Naturally, the air is heated by the fire as it passes sequentially through the cool air manifolds, cool air conduits, warm air manifold and warm air conduits. In addition, air deflectors, not shown, may be attached to the extension tubes 56 to direct the air into any desired portion of the room.

Having described the operation of the present invention, it is now appropriate to describe the manner in which the present invention achieves highly efficient, more complete combustion of the fuel with resulting relatively low pollution output along with reduced flaring of the fire as the volatile substances present in the fuel are burned. It is well-known that for proper combustion it is necessary to regulate the fire supply of both primary air, which causes the solid fuel to burn, and the secondary air, which causes the combustible gases and vapors emitted by the hot, solid fuel to burn.

Referring to FIG. 1, it is preferred there be a relatively airtight fit between the left, right and rear walls 10, 12, 14 of the base. Additionally, because the front wall 28 on the ash pan is sized to completely fill or tightly cover the recess 18 in the base, it is understood that these members form a relatively airtight enclosure which eliminate air reaching the fire from below. Since there is no draft from beneath the fire going directly to the coals, the fire is not hot enough to drive off the volatile substances in the wood in great amounts, which might otherwise cause the fire to flare wastefully with concomitant incomplete combustion of the fuel. As a result, the fire burns more slowly, resulting in a cooler fire with higher efficiency, more complete combustion and less pollution. Since the fire is cooler, destructive oxidation or burn out of the air conduits 50, 54 is also reduced resulting in their having a longer life. It if is desired that the fire burn more quickly, the draft to it may be increased by withdrawing the ash pan 24 to the desired degree.

Access to the fire from the side is also restricted in the present invention by the side panels 32 and by the front and rear manifolds 42, 44, which preferably have a relatively airtight fit at their intersections and at their junctures with the base walls 10, 12, 14 and ash pan 24. Further, their height is selected so that they preferably stand higher than the air conduits 50, 54. This both controls access of the air to the fire and acts as an enclosure to contain the coals and other fuel. As a result of this relatively airtight construction, combustion air in the present invention must reach the fuel from above which causes a slower burning fire with all of the advantages previously described.

From the foregoing, various further applications, modifications, and adaptations of the apparatus disclosed by the foregoing preferred embodiments of the present invention, will be apparent to those skilled in the art to which it pertains, within the scope of the following claims.

What is claimed is:

1. An air-heater type fireplace grate including tubular portions on which a fire is built and through which forced air is directed to be heated prior to being discharged into a room, characterized by:

a frame comprising a support base adapted to set on the floor of a fireplace firebox, spaced apart tubular front and rear air manifolds occupying upper front and upper rear positions on said base, and means connecting said front and rear manifolds to said base to make said frame an integral rigid structure;

said front and rear tubular air manifolds having opposed pairs of openings formed therein; and a plurality of air-heating and fire supporting tubes extending between the front and rear manifolds, with end portions thereof snugly received within said openings but free of other connection to the front and rear manifolds so that they can expand and contract independently in response to uneven heating.

2. A fireplace grate according to claim 1, wherein the base comprises an elongated side member at each side of the grate which extends rearwardly from a position below its end of the front air manifold to a position below its end of the rear air manifold, and said means connecting the front and rear air manifolds to the base to make the frame an integral rigid structure comprises detachable fasteners connecting end portions of the air manifolds to end portions of the side members.

3. A fireplace grate according to claim 2, wherein each said side member includes an upper frame portion extending between said front and rear air manifolds and having ends which abut tight against the rear and front faces of the front and rear air manifolds, and wherein when the front and rear air manifolds are attached to the support base by the detachable fasteners the tight fit of the ends of the upper frame portions against the rear and front faces of the front and rear air manifolds contributes substantially to making the corners of the frame rigid.

4. A fireplace grate according to claim 1, wherein the support base comprises a side frame member at each side of the grate which extends rearwardly from its end of the front air manifold to its end of the rear air manifold, said side members defining a slideway at each side of the grate, and said grate including an ashpan which fits into said slideways and is movable like a drawer into and out from a position below the air-heating fire support tubes.

5. A fireplace grate according to claim 4, wherein said side members are lengths of channel arranged to open towards each other, so that the flange and web portions of the channels define the slideways for the ashpan.

6. A fireplace grate according to claim 4, comprising a pervious coals supporting member positioned vertically below the air-heating and fire supporting tubes and vertically above the ashpan.

7. A fireplace grate according to claim 6, wherein said frame includes closure means bordering the grate and serving to limit the flow of combustion air into the combustion zone, from below the grate, and wherein the ashpan includes a forward wall which with the front air manifold defines an inlet for combustion air into the space below the air-heating and fire supporting tubes which is adjustable in size by a front-to-rear positioning of the ashpan.

8. A fireplace grate according to claim 1, wherein the front air manifold includes a cold air inlet, wherein a first set of said air-heating and fire supporting tubes are in air receiving communication with the front air manifold and in air delivering communication with the rear air manifold, and wherein a second set of air-heating and fire supporting tubes are in air receiving communication with the rear air manifold and at their opposite ends communicate with outlet structure for discharging the heated air into a room.

9. A fireplace grate according to claim 8, wherein the first set of air-heating and fire supporting tubes are located at the sides of the grate and the second set of air-heating and fire supporting tubes are located centrally of the grate, between the first set of air-heating and fire supporting tubes.

10. A fireplace grate according to claim 1, wherein the front and rear tubular air manifolds constitute lengths of metal tubing, wherein said support base comprises a side member at each side of the grate, each of which is a length of metal stock which extends from a position below its end of the front air manifold to a position below its end of the rear air manifold, wherein the air-heating and fire supporting tubes are all lengths of thin wall tubing, and wherein the means connecting the front and rear air manifolds to the support base include detachable fasteners connecting the end portions of the front and rear air manifolds to the end portions of the side members.

11. An air-heater type fireplace grate including tubular portions on which a fire is built and through which forced air is directed to be heated prior to being discharged into a room, characterized by:

spaced apart tubular front and rear air manifolds;

an elongated side member on each side of the grate, each such member extending from a position below its end of the front air manifold rearwardly to a position below its end of the rear air manifold;

a plurality of air-heating and fire supporting tubes extending between the front and rear manifolds;

a pervious coals support member positioned vertically below the air-heating and fire supporting tubes;

said side members defining a slideway on each side of the grate; and an ashpan which fits into said slideways and is movable like a drawer into and out from a position below the air-heating fire support tubes and the previous coals supporting member.

12. A fireplace grate according to claim 11, wherein each side member is a length of channel stock arranged to open towards each other, so that the flange and web portions of the channel define the slideways for the ashpan.

13. A fireplace grate according to claim 4, wherein said grate includes closure means bordering the grate and serving to limit the flow of combustion air into the combustion zone from below the grate, and wherein the firepan includes a forward wall which with the front air manifold defines an inlet for combustion air for the space below the air-heating and fire supporting tubes, which inlet is adjustable in size by a front-to-rear positioning of the ashpan.

14. A fireplace grate according to claim 11, wherein the front air manifold includes a cold air inlet, wherein a first set of said air-heating and fire supporting tubes are in air receiving communication with the front air manifold and in air delivering communication with the rear air manifold, wherein a second set of air-heating and fire supporting tubes are in air receiving communication with the rear air manifold and at their opposite ends communicate with outlet structure for discharging the heated air into a room.

* * * * *